US007157127B2

(12) United States Patent
Schmelzer

(10) Patent No.: US 7,157,127 B2
(45) Date of Patent: Jan. 2, 2007

(54) LABEL FOR STRETCH WRAPPED STACK

(75) Inventor: Winfried Schmelzer, Mechernich (DE)

(73) Assignee: The Procter & Gamble Company, Cincinnati, OH (US)

( * ) Notice: Subject to any disclaimer, the term of this patent is extended or adjusted under 35 U.S.C. 154(b) by 147 days.

(21) Appl. No.: 10/753,573

(22) Filed: Jan. 8, 2004

(65) Prior Publication Data

US 2004/0191456 A1 Sep. 30, 2004

Related U.S. Application Data

(63) Continuation-in-part of application No. PCT/US02/31051, filed on Sep. 30, 2002.

(30) Foreign Application Priority Data

Sep. 28, 2001 (EP) ..... 01123429

(51) Int. Cl.
*B65D 65/00* (2006.01)
*G09F 3/02* (2006.01)

(52) U.S. Cl. ..... 428/40.1; 206/497; 428/41.7; 428/41.8; 428/42.1; 428/42.2; 428/42.3; 428/43; 428/192; 428/194

(58) Field of Classification Search ..... 428/40.1, 428/41.7, 41.8, 42.1, 42.2, 42.3, 43, 192, 428/194; 206/497
See application file for complete search history.

(56) References Cited

U.S. PATENT DOCUMENTS 4,995,641 A 2/1991 Landry et al.
5,509,694 A * 4/1996 Laurash et al. ..... 283/81
5,618,600 A * 4/1997 Denklau ..... 428/41.8
5,653,473 A * 8/1997 Laszutko et al. ..... 283/81
6,133,195 A 10/2000 Murphy

FOREIGN PATENT DOCUMENTS

JP 10 111654 A 4/1998
JP 2000 122555 A 4/2000
JP 2001 034171 A 2/2001

* cited by examiner

*Primary Examiner*—Nasser Ahmad
(74) *Attorney, Agent, or Firm*—Peter D. Meyer; David M. Weirich; Betty J. Zea

(57) ABSTRACT

A label for adhesive attachment to a stack of articles combined by an exterior substrate. The label includes a label material having a pair of outer label regions, a central label region, a signal surface having indications and an adhesive surface, the adhesive surface being provided with an adhesive. The label also includes a protective release cover, wherein the release cover is releasably attached to the adhesive surface of the label. The release cover also includes at least two separating lines, wherein the separating lines divide the release cover into two outer regions separated by a center region such that the regions of the release cover can be removed from the label material independently from each other.

1 Claim, 2 Drawing Sheets

LABEL FOR STRETCH WRAPPED STACK

CROSS REFERENCE TO RELATED APPLICATIONS

This application is a continuation-in-part of International Application No. PCT/US02/31051, with an international filing date of Sep. 30, 2002.

FIELD OF THE INVENTION

The present invention relates to labels which are adhesively attached to the outside of a stack of packages or articles which packages or articles are combined on a pallet typically by a stretch wrapped film. Such stretch wrapped stacks are highly stable but due to the stretch in the film used for holding the stack together and depending on the compressibility of the packages or articles, the stack will shrink by a certain amount during further handing and shipment. Such stretch wrapped stacks are usually provided with labels, which have to allow the stretch wrapped stack to shrink and be deformed to a certain extent during handing and shipment. The present invention relates to labels, which are designed, to achieve a substantial improvement in stability after having been applied to a stretch wrapped stack of packages or articles.

BACKGROUND ALL THE INVENTION

Especially for handing and shipment of shrink wrapped stacks, it has become usual to provide them with large and easily identifiable labels, which may desirably be machine-readable. The most common label indications are bar codes. Of course these labels, if adhered to the shrink wrap prior to shrinking the wrap, should allow for shrinking or else they may crumple and wrinkle. This may cause the information on the label such as, for example, a bar code, to become unreadable and cause the further handing and shipment to become more difficult if not impossible, as the information on the label may not be usable.

Hence there exists a problem of providing labels for shrink wrapped stacks or otherwise combined articles wherein the information on the labels remains readable throughout the handing and shipping. In particular, it would be advantageous to provide labels that are not adversely affected by the potential shrinking of the stack or other deformation which may occur during handing and shipment.

SUMMARY OVER THE INVENTION

The present invention relates to a label for adhesive application to a stack of articles which stack is combined with an exterior substrate such as a stretch wrapped film. The label has a signal surface with indications and on its opposed side an adhesive surface for the attachment to the exterior substrate of the stack of articles. The adhesive surface is provided with a release cover which is releasably attached to the adhesive on the adhesive surface. The release cover has two separating lines which provide two outer regions of the release cover and one center region intermediate the two outer regions. Thus, the different regions of the release cover can be removed without having to remove the release cover in the other regions.

DETAILED DESCRIPTION OF THE EMBODIMENTS OF THE PRESENT INVENTION

Figure 1:
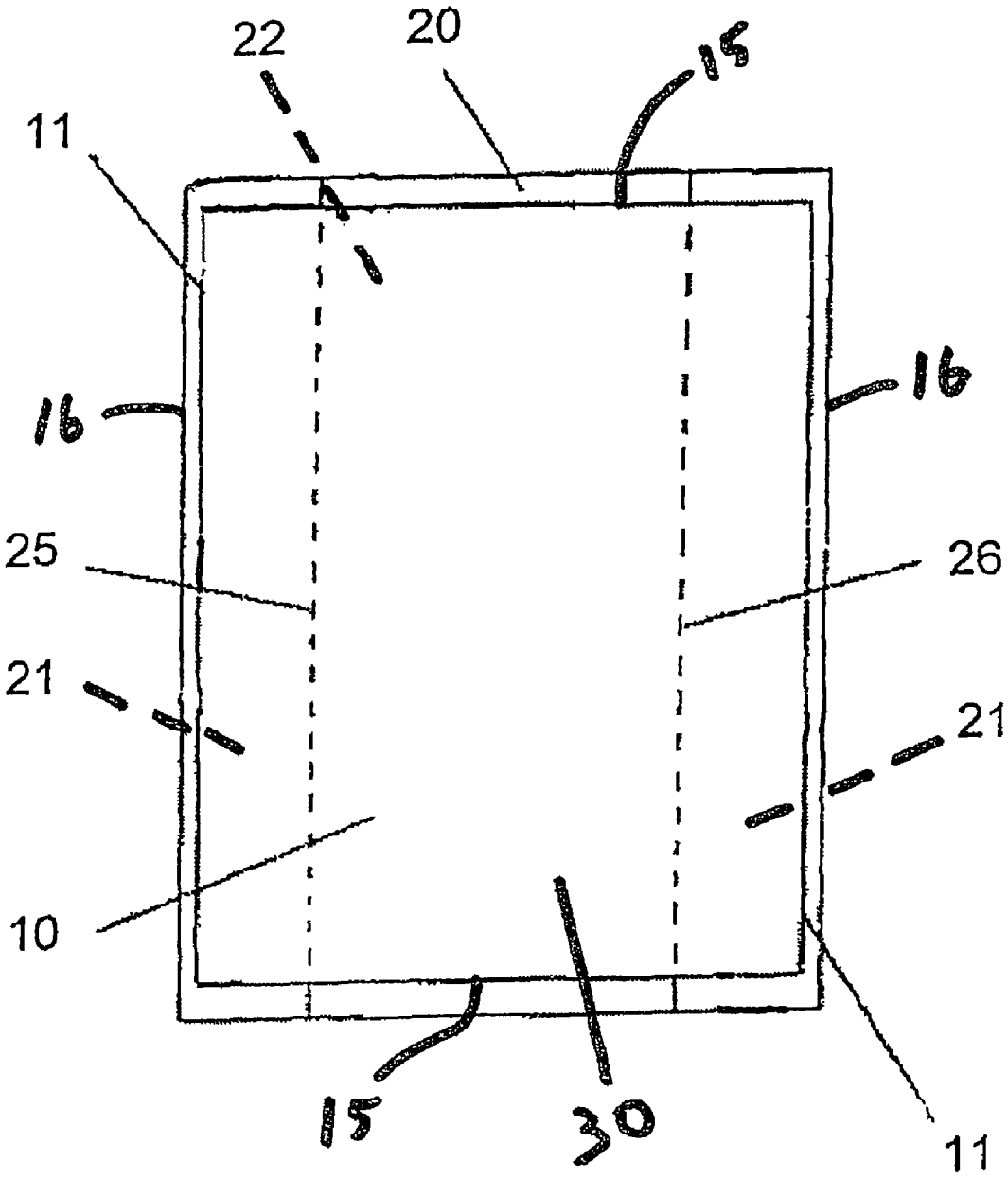
FIG. 1 shows an individual label in accordance with the present invention.

According to the present invention a label for adhesive application to a stack of articles is shown in FIG. 1. A stack of articles can for example be a number of small packages of products, such as plastic bags, comprising smaller quantities of products than the whole stack. Such stacks of articles are typically created on a pallet such that they are easy to handle for shipment and transport. The products inside each article, for example a carton or a plastic bag, can be any kind of product and can be of the type that are subdivided into smaller quantities for further distribution, sale or handling. A good example in this respect are absorbent products, such as diapers, sanitary napkins or adult incontinence products which are packed together in a small number, being reasonable for those purchasing such products. The package in which these products are provided is typically flexible, for example a plastic bag. The packages are generally intended to provide aesthetics and protection from the environment for the product. In the context of the present invention, such packages are referred to as articles and they are combined in a stack to form a larger shipment unit. The most frequently used way of combination of such stacks into a unitary transportable and easy-to-handle unit is to palletize them and to wrap the whole pallet including the packages with a stretch or shrink wrapped film. Such stacks of articles in accordance with the present invention are provided with the label according to the present invention in order to identify the content and possibly indicate other information about the content of such a stack.

In the context of such stacks which are combined by use of a stretch or shrink wrapped film or more generally an exterior substrate, it is desirable that the label attached on the outside of the substrate be readable during the entire transportation and handling process. In particular stretch wrap film has a tendency to continue to shrink during such handling because empty spaces and voids inside the stack are gradually shaken out and the strength of the film allows further compression of the unified stack of articles. For a label, it is desirable that the label be able to either follow such deformation or prevent the deformation to that part of the label which carries the information of the label.

The present invention addresses the above noted problems by providing a label, for example, in accordance with FIG. 1 in which the label 10 is shown from its signaling surface 11. No signals are indicated on the label, but often bar codes would be provided with the bars extending between line 25 and line 26 for reading e.g. by a laser scanner. The label shown is generally rectangular and is provided with an adhesive surface 12 on the reverse side of the signaling surface 11. The adhesive 13 may extend across the whole label 10 on the adhesive surface 12, but is not required to be co-extensive with the whole label 10. The adhesive 13 should be selected such that the attachment to the exterior substrate of the stack is safely provided released from the release cover 20, is facilitated without problems.

In FIG. 1 the release cover 20 is shown to extend beyond the side edges 14 of the label 10. As shown in FIG. 1, the release cover 20 is shown to extend beyond end edges 15. This, however, is not necessary but may be desirable if the adhesive surface on the label extends to the side edges 14 of the label 10. In one exemplary embodiment, the side edges 16 of the release cover 20 may be co-extensive with and aligned with the side edges 14 of the label 10.

The release cover 20 has at least two separating lines 25, 26, as shown in FIG. 1, which may be provided by cutting the label along the lines 25, 26. These separating lines provide the release cover 20 with two outer regions 21 and a center region 22. The release cover 20 in each region can be removed from the label 10 individually without interfering with the remainder of the release cover 20. This then allows removal of the outer region 21 of the release cover 20 from the label 10 without removing the center region 22 of the release cover. If such a label 10 is attached to a stack, its central region 30 substantially coextensive with the central region 22 of the release cover 20, it will be provided with additional strength for withstanding the wrinkling, which is otherwise possible when attaching the label 10 across its whole surface to an exterior substrate on a stack of articles.

The separating lines 25,26 do not need to divide the outer regions 22 from the center region 22 such that these regions are immediately adjacent. However, the separating lines 25,26 may be provided by a micro cut that is run through the release cover 20 while the label 10 has already been joined by its adhesive 13 to the release cover 20.

Figure 2:
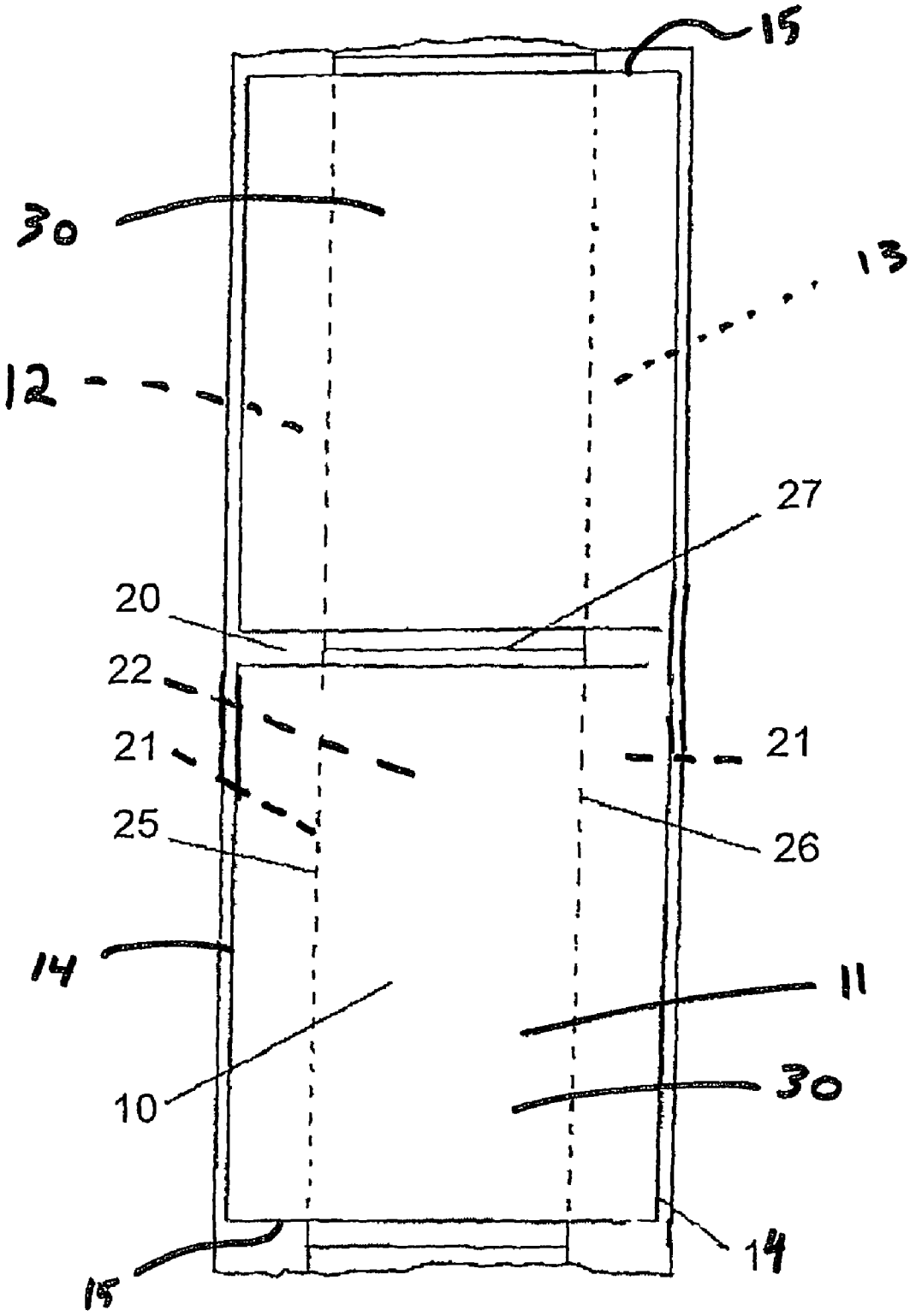
FIG. 2 shows a continuous band of a multitude of labels also in accordance with the present invention.

In another embodiment, a similar label 10 and release cover construction as shown in FIG. 1 is combined to a series or band of labels on a release cover 20. The continuous part of the release cover 20 shown in FIG. 2 is that portion which continuously extends in the outer region 21. In principle, labels as shown in FIG. 1 can be made continuously by joining the adjacent outer regions 21 of the release cover 20 between the labels 10, for example with a tape tab. However, in certain embodiments, as shown in FIG. 2, a continuous band of release cover material is cut by micro-cutting along the separating lines 25, 26 in a continuous fashion and also provided with a center region separating line 27 where adjacent center regions between labels 10 are disconnected. This line 27 may be provided by the same cutting mechanism as the separating lines 25, 26 or by any other known cutting method. The labels 10 on such an endless band can be separated between labels 10 as shown in FIG. 2. However, this is not necessary and embodiments are contemplated wherein the labels 10 are provided immediately adjacent to each other so that end edges 15 of the adjacent labels are touching each other.

The labels 10 according to the present invention may be made from any suitable material, such as, for example a polymeric film. The film should allow for any desired signal indications. Usually such materials are provided as a role that can be unwound and be combined with the release cover material. The release cover material may be any suitable material such as a release-coated paper, and may be provided as a role. Such materials can be combined, for example, by providing the adhesive 13 for the label 10 onto the release coated release cover surface, joining the release cover surface with the material of the label 10 in which step also the adhesive may transfer from the release cover surface to the label material. The label 10 can then be cut on one side of the laminate formed between the label material, adhesive 13 and release cover system in order to shape the labels. This cutting step can be such that no part of the label material needs to be removed. When considering the design shown in FIG. 2 or FIG. 1 of the label 10, the rim of the label material may be removed from such a system. This creates clear definition of where the label 10 is and allows easy access to remove the label 10 from the release cover 20. As another step in the process of creating labels in accordance with the present invention, the release cover 20 may be cut along the separating lines 25, 26 and further cut along line 27 separating adjacent center regions of the release cover 20 between labels 10. This can be provided by micro cutting extending only into the depth of a material so it does not create a cut in the adhesive surface 12 of the label 10 or by any other means or method such as, for example, die cutting, laser cutting, perforation, etc.

The labels 10 created in such a system may also be provided in shapes and designs other than the generally rectangular shape shown in the figures. For example rounded edges have found wide spread use in the field of labels which the present invention does of course also support. In principle the present invention allows combination with all those aspects of modern labeling technology usual in the art without removing any of the characteristic features of the present invention.

The experienced practitioner will however readily recognize that the embodiments discussed herein above are just a few of the embodiments of the present invention that can provide the benefit of creating the added wrinkle resistance in the center region of the label 10 adjacent the center region 22 of the release cover. In many cases, such benefits can be achieved without additional cost, complexity for labeling system or burden in material consumption on the disposal system of a manufacturer.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A stack of articles held together by a stretch wrap film having an outside surface, the stack having attached on the outside surface of said stretch wrap film a label, said label comprising a label material including a pair of outer label regions, a central label region, a signal surface having indications and an adhesive surface located on the reverse side of the signaling surface, said adhesive surface being provided with an adhesive and; a protective release cover, said release cover being releasably attached to said adhesive surface of said label; said release cover including at least two separating lines, the separating lines dividing the release cover into two outer regions separated by a center region; wherein the regions of the release cover can be removed from the label material independently from each other, the label being attached to the outside surface of the stretch wrap film in both outer label regions by the adhesive while the center region of the release cover remains on the label and is disposed between the label and the outer surface of the shrink wrap film so as to prevent the label from being adhesively joined to the stretch wrap film where the center region of the release cover is attached to the label.

* * * * *